US006192539B1

(12) United States Patent
Fraga et al.

(10) Patent No.: US 6,192,539 B1
(45) Date of Patent: Feb. 27, 2001

(54) HAMMER WITH HOLDER

(75) Inventors: Juan Carlos Fraga; Roberto Riera, both of North Fort Mayer, FL (US)

(73) Assignee: Juan C. Fraga, North Fort Myers, FL (US)

( * ) Notice: Subject to any disclaimer, the term of this patent is extended or adjusted under 35 U.S.C. 154(b) by 0 days.

(21) Appl. No.: 09/483,590

(22) Filed: Jan. 14, 2000

(51) Int. Cl.[7] ..... B25D 1/04
(52) U.S. Cl. ..... 7/144; 81/20; 81/24; 7/167
(58) Field of Search ..... 81/20, 23, 24, 81/489, 488; 7/143, 144, 167

(56) References Cited

U.S. PATENT DOCUMENTS 352,070 * 11/1886 Robertson ..... 7/143
433,740 * 8/1890 Mitchell ..... 7/144
1,041,903 10/1912 Thomas .
1,701,904 * 2/1929 Ailor ..... 7/143
2,671,483 * 3/1954 Clark ..... 7/143
5,062,324 * 11/1991 Saviano ..... 81/20

* cited by examiner

*Primary Examiner*—David A. Scherbel
*Assistant Examiner*—Joni B. Danganan
(74) *Attorney, Agent, or Firm*—J. Sanchelima

(57) ABSTRACT

A hammer tool that has a handle member with grip and head ends. The head end includes a head assembly mounted thereon at an angle to give a user sufficient clearance for his/her hand grip when using the claw assembly built-in in the face. A blade assembly is removably mounted on the head assembly opposite the face and claw assembly. A magnetic member is inserted in the face portion to facilitate the manipulation of ferromagnetic nails. A holder with a frame and a loop is provided to support the hammer. The frame includes a hook member to which a headed engagement pin is removably mounted. When the hammer is mounted to the holder, the handle is kept at a convenient distance from a user's hands.

3 Claims, 3 Drawing Sheets

HAMMER WITH HOLDER

BACKGROUND OF THE INVENTION

1. Field of the Invention

The present invention relates to a hammer, and more particularly, to a hammer with a non-perpendicular handle member with a holder.

2. Description of the Related Art

Applicant believes that the closest reference corresponds to U.S. Pat. No. 1,041,903 issued to W. Thomas. However, it differs from the present invention because the Thomas-patent includes a complicated mechanism for holding the nail in place. The present invention provides a hammer with a non-perpendicular handle member to allow for a user's hand not to come in contact with the surface where the nail is driven. The present invention includes also a magnetized head with a claw assembly integrally built on the face portion of the head that minimizes the movements required from a user when using the claw assembly. Finally, the blade assembly opposite to the head facilitates the work of a user specially when working on roofs.

Other patents describing the closest subject matter provide for a number of more or less complicated features that fail to solve the problem in an efficient and economical way. None of these patents suggest the novel features of the present invention includes a magnetized head with a claw assembly integrally built on the face portion of the head.

SUMMARY OF THE INVENTION

It is one of the main objects of the present invention to provide a hammer with a non-perpendicular handle member so that a user may position the claw assembly of the hammer's head at an angle with respect to a horizontal surface thereby providing sufficient clearance for a user's grip of the handle member.

It is another object of this invention to provide a hammer that includes a magnetized head with a claw assembly integrally built on the face portion of the head.

It is still another object of the present invention to provide an improved hammer with a removably blade assembly mounted on the head of the hammer, opposite to the face portion.

Still another object of this invention is to provide a holder for the improved hammer that makes the latter readily available.

Another object is to provide a hammer and holder combination specially suitable for a roofer.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
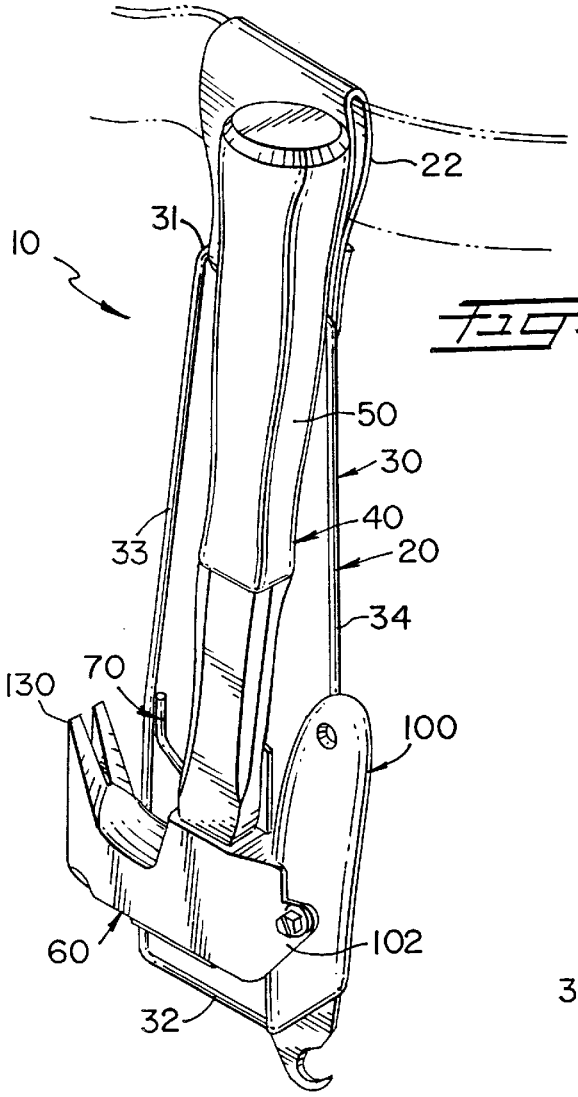
FIG. 1 represents an isometric view of one of the preferred embodiments for the present invention with a belt (in phantom).
Figure 2:
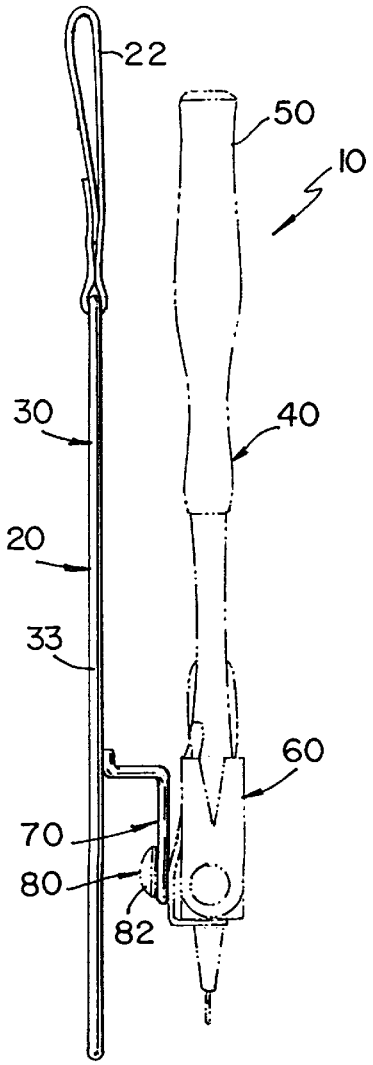
FIG. 2 shows a side elevational view of the holster and the hammer (in phantom) mounted thereon.

Referring to the drawings, where the present invention is generally referred to with numeral 10, it can be observed that it basically includes holster assembly 20 typically carried by a user on his/her belt and improved hammer assembly 40, that includes handle member 50 and head assembly 60 mounted at one end. Handle member 50 is rigidly mounted to head assembly 60 so that it is not perpendicular, but rather it is mounted at an angle between 5 and 10 degrees. In a typical hammer, head assembly 60 and the handle assembly are perpendicularly mounted to each other. This relatively small angle permits a user to grab handle member 50 and strike a flat surface (or drive a nail in) and specially to use claw assembly 130 without hitting his hand. Using claw assembly 130 typically requires that a user insert it at an angle, therefore, unless allowance is provided for this a user would not be able to use claw 130 when it is integrally built on head assembly 60. Of course, there is an advantage for having claw assembly 130 as an extension of the face portion, namely, a user does not have to turn around the handle. Rather, it is right there. This is desirable when working in rough surfaces such as roofs, where irregularities tend to scratch a user's hands.

Figure 3:
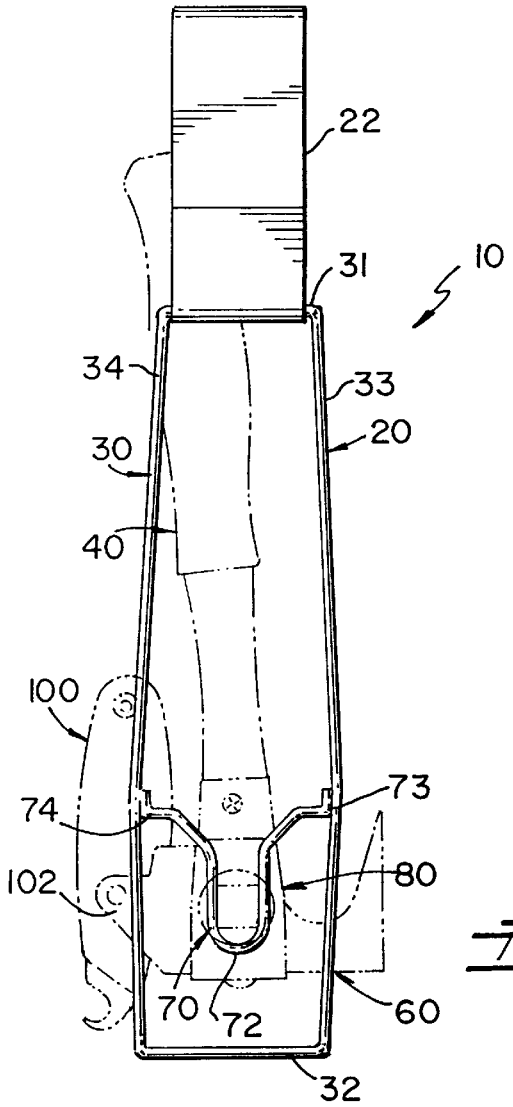
FIG. 3 illustrates a back elevational view of the holster and the hammer (in phantom) mounted thereon.

As it can be seen in FIG. 1, holster assembly 20 includes loop member 22 which in the preferred embodiment is made out of a flexible material through which a user's belt is passed. Frame assembly 30, as best seen in FIG. 3, extends downwardly. Loop member 22 permits a user to insert his/her belt through it, keeping frame assembly 30 suspended in a substantially vertical position.

Frame assembly 30 includes upper and lower rigid elongated members 31, 32, and side rigid elongated members 33 and 34. Members 31; 32; 33 and 34 are joined to each other defining a frame. Between members 33 and 34 there is a hook assembly 70 that includes U-shaped member 72 with outwardly extending legs 73 and 74 that are rigidly attached to members 33 and 34, respectively.

Head assembly 60 includes headed pin assembly 80 perpendicularly mounted on side 62. Assembly 80 is designed to engage hammer 40 to holder 20. Assembly 80 is mounted to head assembly 60 through fastening members 81 and 83 that are passed through holes 81' and 83', and driven into openings 61 and 53, respectively. Pin head 82 is kept at spaced apart relationship with respect to side 62 so that it can be removably inserted within the bay of U-shaped member 72. Hook assembly 70 is positioned substantially closer to member 32 than to member 31, so that handle member 50 is kept at a confortable distance from a user's hand.

Figure 4:
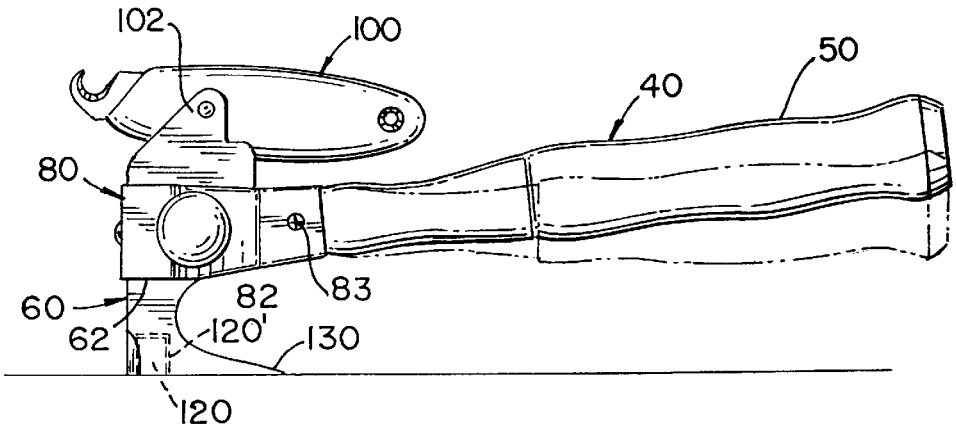
FIG. 4 is a front view of the hammer subject of the present application and the position of the handle of the prior art hammer is shown in phantom.

Blade assembly 100, is removably mounted to one end of head assembly 60, as seen in FIG. 4. Bracket 102 is designed to removably support assembly 100 and keep the latter at a suitable distance away from head assembly 60.

Figure 5:
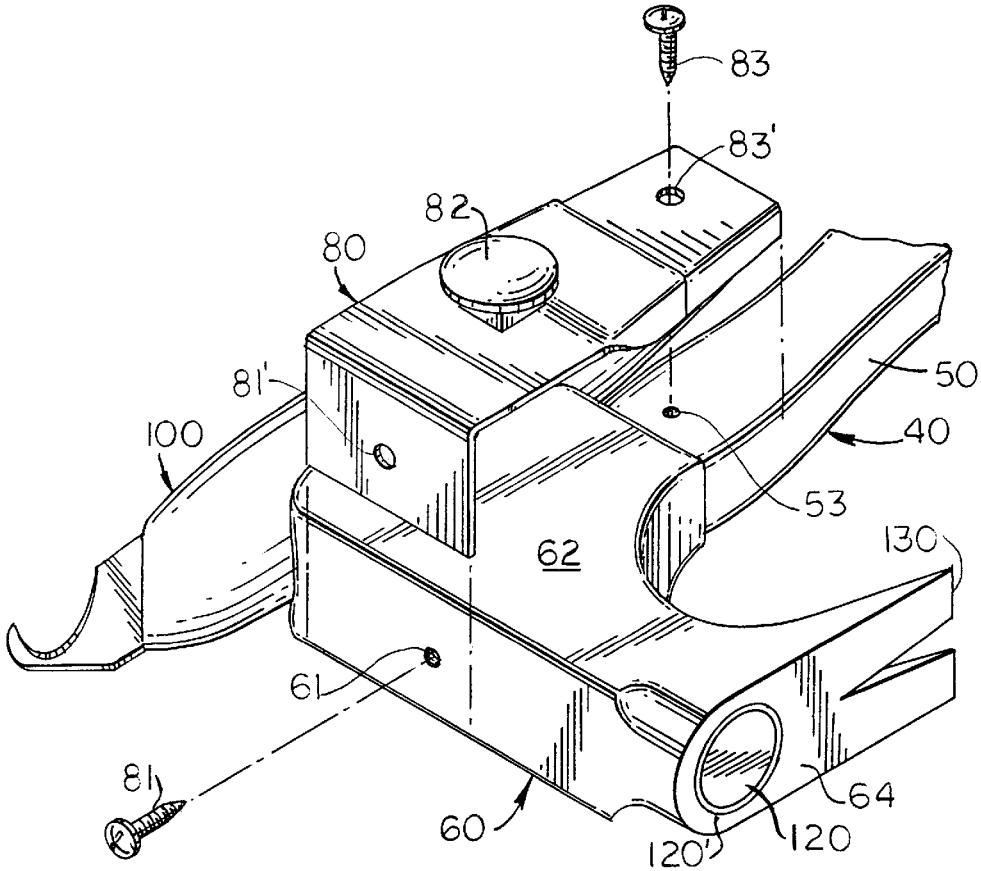
FIG. 5 is an exploded view of the head assembly.
Figure 6:
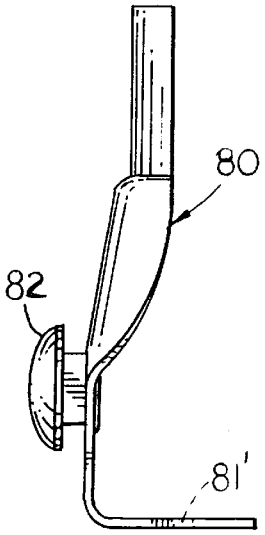
FIG. 6 illustrates a side elevational view of the headed pin assembly.
Figure 7:
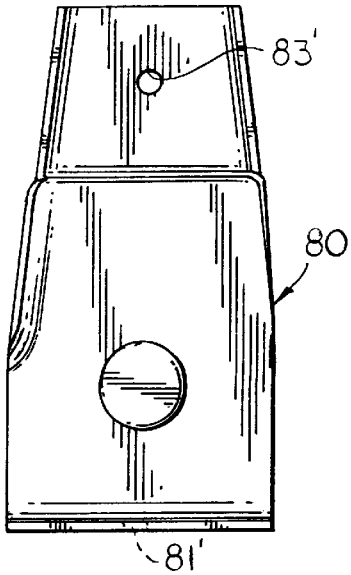
FIG. 7 represents a back view of the headed pin assembly.

Magnetic member 120 is seen in FIGS. 4 and 5 as a cylindrical insert in face portion 64. Member 120 is designed to hold ferromagnetic nails by their heads facilitating the nailing operation. Member 120 is covered with a case 120' of nonferrous material.

Claw assembly 130 extends from face portion 64 towards handle member 50. It is designed to be readily available to a user in the event that it needs to be used to pull a nail out.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hammer tool and holder combination, comprising:

A) handle means having a longitudinal axis, a grip end and a head end;

B) a head assembly mounted to said head end and said head assembly further including first and second ends, said first end having a face with a magnetic member inserted therein and further including a claw assembly integrally built on said face and extending toward said grip end, said head assembly includes a blade assembly removably mounted to said second end and said head assembly being mounted to said head end at an inclination with respect to said handle means so that the plane of said face and the longitudinal axis of said handle means form an angle between 5 and 10 degrees; and C) a holder for keeping said handle means in suspension, said holder includes an elongated frame with hook means mounted thereon and said head assembly further includes means for engaging said hook means that includes a headed pin member, and said holder further includes a loop for receiving a user's belt so that said handle means, when supported by said holder, is kept at a cooperative and convenient position for a user to readily grab said handle means.

2. A tool comprising

A) handle means having a longitudinal axis, a grip end and a head end and said head end further including a headed pin member perpendicularly mounted thereon; and B) a holder having an elongated shape with first and second ends, said first end having means for removable attachment to a user's waist belt, said second end including hook means for cooperatively removably receiving said headed pin member so that said handle means is suspended substantially in alignment with said holder with said grip end adjacent to said first end wherein said holder is made out of a rigid wire defining substantially a rectangle.

3. The tool set forth in claim 2 wherein said hook means includes a U-shape rigid wire member mounted within said rectangle.

* * * * *